US011993878B2

(12) United States Patent
Polosa et al.

(10) Patent No.: US 11,993,878 B2
(45) Date of Patent: May 28, 2024

(54) MANUFACTURING LINE FOR NONWOVEN FABRIC

(71) Applicant: Suominen Corporation, Helsinki (FI)

(72) Inventors: Gian Luca Polosa, Varese (IT); Avinav G. Nandgaonkar, Vernon, CT (US); Pramod U. Shanbhag, Branford, CT (US)

(73) Assignee: Suominen Corporation, Helsinki (FI)

( * ) Notice: Subject to any disclaimer, the term of this patent is extended or adjusted under 35 U.S.C. 154(b) by 911 days.

(21) Appl. No.: 17/037,759

(22) Filed: Sep. 30, 2020

(65) Prior Publication Data

US 2021/0095406 A1 Apr. 1, 2021

(30) Foreign Application Priority Data

Sep. 30, 2019 (FI) ..... U20194131

(51) Int. Cl.

| | |
|---|---|
| ***D04H 1/49*** | (2012.01) |
| ***D04H 1/492*** | (2012.01) |
| ***D04H 5/08*** | (2012.01) |
| ***D21G 1/00*** | (2006.01) |

(52) U.S. Cl.

CPC ..... *D04H 1/49* (2013.01); *D04H 1/492* (2013.01); *D04H 5/08* (2013.01); *D21G 1/0093* (2013.01)

(58) Field of Classification Search

CPC ..... D04H 1/49; D04H 1/492; D04H 1/495; D04H 3/11; D04H 5/03; D04H 18/04; D04H 5/08; D04H 1/425; D04H 1/732; D04H 5/10; D04H 1/48; D04H 1/485; D21G 1/0093; D21F 9/00

USPC ..... 28/104, 105

See application file for complete search history.

(56) References Cited

U.S. PATENT DOCUMENTS

| | | | | | |
|---|---|---|---|---|---|
| 5,573,841 | A * | 11/1996 | Adam | D04H 1/425 | 428/326 |
| 6,007,653 | A * | 12/1999 | Pirinen | D04H 1/492 | 264/109 |
| 8,318,318 | B2 * | 11/2012 | Luo | B32B 5/06 | 442/389 |
| 2002/0115370 | A1 * | 8/2002 | Palacio | D04H 1/492 | 442/408 |

(Continued)

FOREIGN PATENT DOCUMENTS

| | | | | |
|---|---|---|---|---|
| CA | 2396286 C | * | 5/2008 | D04H 1/4242 |
| CN | 101124358 A | * | 2/2008 | B32B 5/26 |

(Continued)

OTHER PUBLICATIONS

English language translation of EP 1524350 A1; Sommer, Sebastian; Doc Pub Apr. 2005. (Year: 2005).*

(Continued)

*Primary Examiner* — Amy Vanatta
(74) *Attorney, Agent, or Firm* — Laine IP Oy

(57) ABSTRACT

Nonwoven fabric manufacturing line, which comprises a forming device for forming a fibre web on a moving web-forming base and a spunlacing device for reinforcing the web. Further, the line comprises at least one first drying device for drying the web and a calender for forming patterning in the web. The manufacturing line comprises at least one second drying device for drying the calendered web, which second drying device is located after the calender in the direction of travel of the web.

15 Claims, 1 Drawing Sheet

(56) References Cited

U.S. PATENT DOCUMENTS

| | | | | |
|---|---|---|---|---|
| 2003/0114071 | A1* | 6/2003 | Everhart | D04H 1/49<br>442/364 |
| 2014/0037906 | A1* | 2/2014 | Polosa | D04H 1/54<br>428/167 |

FOREIGN PATENT DOCUMENTS

| | | | | |
|---|---|---|---|---|
| DE | 2655136 | A1 | 6/1978 | |
| DE | 10050512 | A1 | 5/2002 | |
| DE | 69811646 | T2 | 12/2003 | |
| DE | 102006042507 | A1 | 3/2008 | |
| EP | 0357474 | A1 | 3/1990 | |
| EP | 0373974 | A2 | 6/1990 | |
| EP | 0624209 | B1 | 9/1996 | |
| EP | 1206927 | A1 | 5/2002 | |
| EP | 1524350 | A1 * | 4/2005 | B32B 5/022 |
| EP | 2692924 | A1 | 2/2014 | |
| EP | 3715515 | A1 | 9/2020 | |
| GB | 1595300 | A * | 8/1981 | D21H 13/24 |
| WO | WO2005106116 | A1 | 11/2005 | |
| WO | WO2019115875 | A1 | 6/2019 | |

OTHER PUBLICATIONS

Russell: Handbook of nonwovens. Woodhead Publishing Series in Textiles, 2007, pp. 256-257.

* cited by examiner

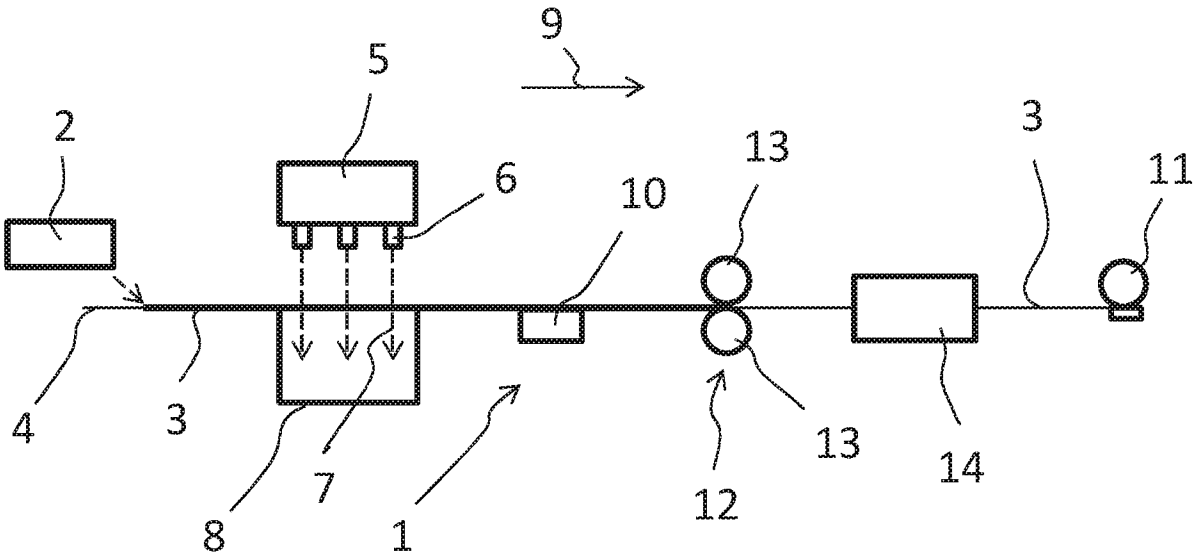
2
4
3
5
6
7
8
9
10
1
13
13
12
3
14
11

MANUFACTURING LINE FOR NONWOVEN FABRIC

FIELD OF TECHNOLOGY

The invention relates to a manufacturing line, according to the preamble to claim 1, for a nonwoven fabric, and correspondingly a method for manufacturing the nonwoven fabric.

BACKGROUND

Numerous different types of properties are required of nonwoven fabric wiping products. They must have sufficient absorbency, strength, and wear resistance for the intended use. In addition, they must be sufficiently biodegradable, so as to not lead to long-term environmental loading.

Decorative patterning is made in nonwoven-fabric products, and the patterns can also transmit information in several different ways, as is described, for example, in international patent application PCT/FI2018/050902.

Wet-spreading is a web-forming process used in the manufacture of non-woven fabric, which is a rapid, economical, and environmentally-friendly method. All the water used in wet spreading can be filtered and reused. In wet spreading, the initial operations are similar to those in paper manufacture. The web formed by wet spreading requires binding to achieve a sufficient strength. If the web material contains thermoplastic material, heat can be used to partly melt this material and thus reinforce the web. All thermoplastic materials are not, however, biodegradable, which limits their use as web binders. The web can also be bound chemically with the aid of binders.

Spunlacing is a generally used method to reinforce the web in nonwoven fabric manufacture. In the method, the fibres are needled with the aid of high-pressure water jets. If the web is transported on a base, in which there is a patterned surface, spunlacing can be used to form a permanent pattern in the web surface. The process can then be called water patterning. Water patterning can also be formed on the web's surface using a patterning roll, to which the web is transferred from the spunlacing unit. Water patterning using a patterning roll is described in EP application number 19397518.2.

In addition to water patterning, the web can be patterned using a calender or belt. A drawback with belt patterning is the long time needed to change the belt. In addition, the belt patterning unit is long, thus increasing the length of the manufacturing line. A drawback with patterning performed using a patterning drum is the equipment's high price. A drawback with patterning formed by calendering is, in turn, that the patterning vanishes when the nonwoven fabric wets, particularly if the nonwoven fabric does not contain thermoplastic material.

SUMMARY

The intention of the present invention is to create a new type of nonwoven-fabric manufacturing line and method, by which the problems described above can be reduced.

The intentions of the invention are achieved by means of a manufacturing line, according to claim 1, for a nonwoven fabric, which comprises a forming device to form a fibre web on a moving forming base, a spunlacing device to reinforce the web, at least one first drying device to dry the web, and a calender to form patterning in the web. In addition, the manufacturing line comprises at least one second drying device to dry the calendered web. The second drying device is located after the calender in the direction of travel of the web.

Considerable advantages are achieved by means of the solution according to the invention. The patterning of a nonwoven-fabric product manufactured on a manufacturing line according to the invention does not disappear when the nonwoven-fabric product becomes wet, even though the patterning of the nonwoven-fabric product is made by calendering. In addition, the manufacturing line can be short, because patterning is made by calendering, and a long belt-patterning unit is not needed. A calender is also considerably cheaper than the equipment used in drum patterning.

BRIEF DESCRIPTION OF THE DRAWING

In the following, the invention is described with reference to the accompanying drawing, which shows as a schematic diagram a nonwoven-fabric manufacturing line according to an embodiment of the invention.

DETAILED DESCRIPTION OF THE EMBODIMENT ACCORDING TO THE DRAWING

The drawing shows schematically a patterned nonwoven-fabric manufacturing line 1. A nonwoven fabric is a fabric-like material, which is made by combining fibres in set or random directions, using friction and/or cohesion and/or adhesive. Papers, woven, tufted, sewn, or felted fabrics are not included in the term nonwoven fabrics. Continuous filament fibres, as well as short and long fibres, which can be both natural and artificial fibres, are used in nonwoven fabrics.

The manufacturing line 1 comprises a formation device 2 for forming a fibre web 3 on a moving forming base 4. The forming device 2 is of the type wet-forming devices, for example a headbox, by which a watery fibre suspension is fed to the forming base 4.

Alternatively, the forming device 2 can be of the type dry-forming devices, such as a carding device or an air-spreading device. The fibre web 3 forming on the forming base 4 by carding or air-spreading must then be moistened at a later processing stage, for example by spunlacing.

The forming base 4 is a forming wire. The fibre web 3 can contain biodegradable material.

The manufacturing line 1 comprises a spunlacing unit 5 to reinforce the web. The spunlacing unit 5 comprises at least one nozzle 6 to direct a high-pressure water jet 7 through the web 3. Typically the spunlacing unit 5 comprises several nozzles 6 arranged consecutively, for example 3-15 nozzles 6 arranged consecutively.

The manufacturing line 1 comprises at least one first drying device 8, 10 to dry the web 3. The first drying device 8, 10 is located after the spunlacing unit 5 in the direction of travel of the web 3 and/or at the spunlacing unit 5. The first drying device 8, 10 is arranged to dry the web to a moisture content of 20-50 percent by weight, typically 30-40 percent by weight. The drying device 10 after the spunlacing unit 5 can be a mechanical dryer, a suction dryer, a through-blowing dryer, or an oven dryer, such as, for example, a foulard, a suction dryer, a cylinder dryer, or an omega-dryer. The direction of travel of the web 3 is marked in the drawing with an arrow 9.

A suction dryer 8 operating by vacuum is located at the spunlacing unit 5. If the suction dryer 8 is sufficiently powerful, the desired moisture content of the web 3 can be achieved without a separate dryer 10 after the spunlacing unit 5. Alternatively an additional dryer can be located in connection with the suction dryer 8, for example another suction dryer, in order to achieve the desired moisture content.

The manufacturing line 1 comprises a patterning device to form three-dimensional patterning in the web 3. The patterning device is a calender 12, which comprises two rotating rolls 13, which are arranged in a mutual nip contact and form the nip between which the web 3 is arranged to run. In calendering, the web 3 is shaped by being pressed in the nip between the rolls 13. In addition, in calendering heat can be used in addition to compression to shape the web 3. In one, or both of the rolls 13 is a patterned surface to pattern the web 3. The calender 12 is located after the first drying device 8, 10, in the direction of travel of the web 3. The web 3 arriving at the calender 12 has been dried by the first drying device 10 to a moisture content of 20-50 percent by weight, typically 30-40 percent by weight.

The manufacturing line 1 also comprises at least one second drying device 14 to dry the calendered web 3. The second drying device 14 is located after the calender 12 in the direction of travel of the web 3. The calender 12 is thus between the first drying device 8, 10 and the second drying device 14 in the direction of travel of the web 3. The second drying device 14 is typically a mechanical dryer, through-blowing dryer, or oven dryer, such as, for example, a foulard, cylinder dryer, or omega dryer. The second drying device 14 is arranged to dry the web 3 to its final moisture content, i.e. the moisture content at which the web is brought to the rolling machine 11. The second drying device 14 is the last drying device on the manufacturing line 1.

The manufacturing line 1 also comprises a rolling machine 11 to reel the web 3 onto a roll. The rolling machine 11 is located after the second drying device 14 in the direction of travel of the web 3. The rolling machine 11 is the last device on the manufacturing line 1.

According to the drawing, the manufacturing line 1 operates as follows. A fibre suspension is fed to a moving forming base 4, typically a wire, and a web 3 is formed. A forming device 2, such as wet-spreading, carding, or air-spreading, is used to feed the fibre suspension to the base 4.

Next, the web 3 is spunlaced by directing one or more high-pressure water jets 7 onto the web 3. Spunlacing is performed using a spunlacing unit 5, which comprises at least one nozzle 6, from which a water jet 7 is directed onto the web 3. Typically there are 3-15 consecutive nozzles 6. At the spunlacing unit 5 there is a suction dryer 8, by which water is removed from the web 3.

The web 3 is dried in the first drying stage using at least one drying device 8, 10. In the first drying stage, the web is dried to a moisture content of 30-40 percent by weight.

After the first drying stage, the web is calendered and three-dimensional patterning is formed in it by the calender 12. The calender 12 comprises two rolls 13 arranged in nip contact 13, the web 13 being led through the nip between them. In calendering the web 3 is shaped by pressing it in the nip between the rolls 13. Heat can be used in addition to compression to shape the web 3. The moisture content of the web 3 brought to the calender 12 is 20-50 percent by weight, typically 30-40 percent by weight.

After calendering the web 3 is dried in a second drying stage using a second drying device 14. In the second drying stage, the web 3 is dried to its final moisture content. The web 3 is calendered between the first and second drying stages. After the second drying stage the web 3 is reeled onto a roll by a rolling machine 11.

In the solution according to the invention, the cellulose molecule chains in the wet nonwoven fabric create short-lived hydrogen bonds. At the same time, these molecule chains slide to overlap each other, which increases the number of their hydrogen bond points. When the nonwoven fabric is calendered, the hydrogen bonds are broken. This permits the easier rearrangement of the molecule chains. The pressure caused by calendering reduces the overlapping of the chains and thus also reduces the number of hydrogen bond points. When the pressure of the calendering ceases, the nonwoven fabric can form these hydrogen bonds normally. Because there are fewer of these points, fewer hydrogen bonds are also formed. As the fabric is dried rapidly after this, the molecule chains are practically unable to move on top of each other, so that new hydrogen bond points cannot arise. When the nonwoven fabric is dry, the hydrogen bonds become more permanent bonds and the nonwoven fabric remains in the patterned form. If the nonwoven fabric is wetted again, it begins to form new hydrogen bonds and the cellulose molecules begin to slide on top of each other again. In the calendered areas there is less overlapping of the molecule chains, so that here there come fewer hydrogen bonds. In the uncalendered areas there is more overlapping of the molecule chains and this layering is faster than in the calendered areas, therefore these areas are distinguished even more clearly from the calendered areas and emphasize the three-dimensional effect of the calendered pattern.

The nonwoven fabric made using the solution according to the invention contains natural fibres and/or regenerated fibres. The fibres are bound together by spunlacing. The nonwoven fibre contains at least two different areas, the first area is compressed when wet and the second area is not compressed. In the dry nonwoven fabric there are more hydrogen bond points in the second area than in the first area.

The invention claimed is:

1. A nonwoven fabric manufacturing line, comprising:

a forming device configured to deposit unconsolidated fibres directly onto a moving web-forming base to thereby form a web, a spunlacing device for reinforcing the web, a first drying device for drying the web, a calender for forming patterning in the web via direct contact of a calender roll with the web to thereby for a calendered web, and a second drying device configured to dry the calendered web.

2. The manufacturing line according to claim 1, wherein the first drying device is arranged to dry the web coming to the calender to a moisture content of 20-50 percent by weight.

3. The manufacturing line according to claim 1, wherein the forming device is a wet-spreading device which is arranged to feed a watery fibre suspension comprising the unconsolidated fibres onto the web-forming base.

4. The manufacturing line according to claim 1, wherein the web-forming base is a wire.

5. The manufacturing line according to claim 1, wherein the first drying device is located, in a direction of travel of the web, after the spunlacing device and/or at the spunlacing device.

6. The manufacturing line according to claim 1, wherein the second drying device is a last drying device on the manufacturing line.

7. The manufacturing line according to claim 1, wherein the first drying device is arranged to dry the web coming to the calender to a moisture content of 30-40 percent by weight.

8. A method for manufacturing a nonwoven fabric, comprising:

depositing unconsolidated fibres directly onto a moving web-forming base to form a web thereon, reinforcing the web by a spunlacing operation, drying the web with a first drying device, forming patterning in the web by a calendering operation in which the web is in direct contact with a calender roll to thereby create a calendered web, and drying the calendered web via a second drying device.

9. The method according to according to claim 7, wherein the first drying device is arranged to dry the web coming to the calender roll to a moisture content of 20-50 percent by weight.

10. The method according to claim 8, wherein the web is formed by a wet-spreading device, which is arranged to feed a watery fibre suspension comprising the unconsolidated fibres onto the web-forming base.

11. The method according to claim 8, wherein the web-forming base is a wire.

12. The method according to claim 8, wherein the first drying device is located, in a direction of travel of the web, after a spunlacing unit and/or at the spunlacing unit.

13. The method according to claim 8, wherein the second drying device is a last drying device on the manufacturing line.

14. The method according to according to claim 8, wherein the first drying device is arranged to dry the web coming to the calender roll to a moisture content of 30-40 percent by weight.

15. A method for manufacturing a nonwoven fabric, comprising:

depositing unconsolidated fibres directly onto a moving web-forming base to form a web thereon;

reinforcing the web by a spunlacing operation;

drying the web with a first drying device; and forming patterning in the web by a calendering operation in which the web is in direct contact with a calender roll to thereby create a calendered web;

wherein pressure of the calendering operation reduces an amount of overlapping of cellulose molecule chains in fibres in calendered areas of the web relative to an amount of overlapping of cellulose molecule chains in fibres of uncalendered areas of the web; and wherein the method further comprises drying the calendered web via a second drying device and rapidly enough to ensure the amount of overlapping of cellulose molecule chains in fibres in calendered areas of the web remains below the amount of overlapping of cellulose molecule chains in fibres of uncalendered areas of the web.

* * * * *